United States Patent [19]

Johns

[11] 4,399,860

[45] Aug. 23, 1983

[54] APPARATUS FOR STRIP CASTING

[75] Inventor: Robert H. Johns, Natrona Heights, Pa.

[73] Assignee: Allegheny Ludlum Steel Corporation, Pittsburgh, Pa.

[21] Appl. No.: 193,766

[22] Filed: Oct. 3, 1980

[51] Int. Cl.[3] ..... B22D 11/06; B22D 11/10

[52] U.S. Cl. ..... 164/423; 164/335; 164/427; 164/437; 164/463; 164/488

[58] Field of Search ..... 164/335, 423, 437, 463, 164/488; 222/591

[56] References Cited

U.S. PATENT DOCUMENTS 4,290,476 9/1981 Smith ..... 164/423

OTHER PUBLICATIONS

*Continuous Casting Of Steel,* The Metals Society, London, 1977, pp. 30–31.

*Primary Examiner*—Gus T. Hampilos
*Assistant Examiner*—Richard K. Seidel
*Attorney, Agent, or Firm*—Patrick J. Viccaro

[57] ABSTRACT

An apparatus for continuously casting strip material is disclosed comprising a tundish having an internal cavity for receiving and holding molten metal and an orifice passage through which the molten metal is delivered from the cavity to a casting surface located within about 0.120 inch of the orifice passage and movable past the orifice passage at a speed of from 200 to 10,000 linear surface feet per minute. The tundish has at least one molten metal resistant upper block and at least one molten metal resistant lower block vertically aligned and secured sufficiently to prevent molten metal in the cavity from passing through the interface of the secured blocks. The orifice passage has a substantially uniform width dimension, of at least about 0.010 inch, throughout the longitudinal extent thereof.

34 Claims, 17 Drawing Figures

APPARATUS FOR STRIP CASTING

BRIEF SUMMARY OF THE INVENTION

The present invention relates to a new and improved apparatus for the rapid casting of metallic strip material. More particularly, the present invention is directed to a tundish assembly consisting of a plurality of vertically aligned and secured blocks of molten metal resistant material.

As the development of the strip casting process matures it has become increasingly apparent that the tundish design is an important feature. Accordingly, the optimum construction and materials are sought which renders the assembly of a tundish a relatively simple operation, allows significant flexibility when necessary to change the dimensions of the orifice opening, casting cavity, height of the metallostatic head of molten metal in the tundish, and the like.

The early art of strip casting, such as U.S. Pat. Nos. 905,758 and 993,904 did not recognize that the tundish or the receptical for molten metal should be capable of flexible design features. Also, the more recent references such as U.S. Pat. No. 4,142,571 which disclose a reservoir for holding and for pressurizing molten metal therein, do not seem to suggest a preference in tundish design as taught herein.

Accordingly, a new and improved apparatus for casting metallic strip material is desired which provides increased flexibility over the prior art structures.

The present invention may be summarized as providing a new and improved apparatus for continuously casting strip material comprising a tundish having an internal cavity for receiving and holding molten metal, and an orifice passage through which the molten metal is delivered from the cavity to a casting surface located within about 0.120 inch of the orifice passage and movable past the orifice passage at a speed of from 200 to 10,000 linear surface feet per minute. The tundish has at least one molten metal resistant upper block and at least one molten metal resistant lower block vertically aligned and secured sufficiently to prevent molten metal in the cavity from passing through the interface of the secured blocks. The orifice passage has a substantially uniform width dimension, of at least about 0.010 inch, throughout the longitudinal extent thereof.

Among the advantages of the present invention is the provision of an apparatus which is easily constructed by stacking and securing blocks of molten metal resistant material having internal cavities and a nozzle.

Strip casting tundishes have been made of horizontally stacked blocks. It has been found, however, that significant molten metal attack, and the like typically occurs in the lower portions of a tundish. Therefore, the present invention, which pertains to vertical stacking, as defined herein, provides increased flexibility and construction. In particular, if the bottom portion of a tundish of the present invention must be replaced, only the lower block or blocks need be removed while the upper blocks are reusable.

In addition to ease of construction and reusability, in whole or in part, the present invention has the further advantage of permitting cavity dimensions to be enlarged or reduced by inserting or withdrawing intermediate blocks in the tundish.

An objective of this invention is to provide an apparatus including a tundish which is capable of significant cavity modification while able to maintain the strict dimensional tolerances required, especially at the orifice passage or nozzle, of the tundish with respect to the casting surface.

An advantage of the present invention is that tundish materials; including certain exotic materials, are typically available in sheets or blocks which can be used in their commercially available form without the necessity of intricate casting, cutting or other involved and costly preparatory operations, with a minimum of waste.

Another objective of the present invention is to provide an improved strip casting apparatus in which at least one of the surfaces forming the orifice passage of the tundish may be heated, before, during or after the casting operation.

These and other objectives and advantages will be more fully understood and appreciated with reference to the following detailed description and to the accompanying drawings.

DETAILED DESCRIPTION

Figure 2:
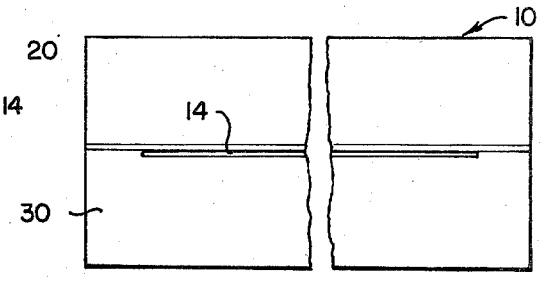
FIG. 2 is a front elevation view of the tundish illustrated in FIG. 1.
Figure 3:
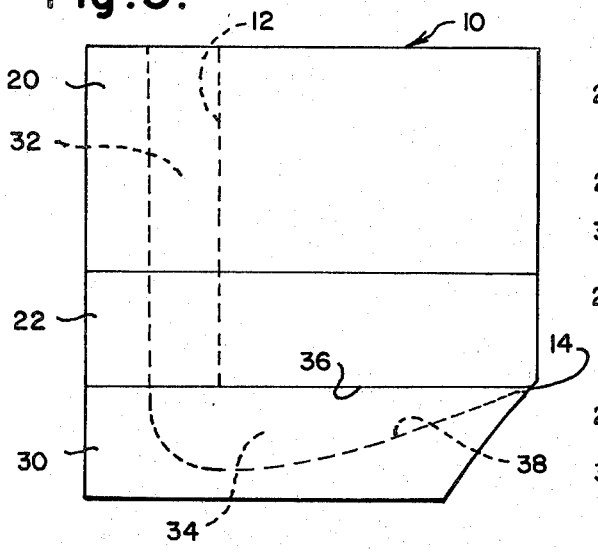
FIG. 3 is a side elevation view illustrating an alternative tundish of the present invention.
Figure 4:
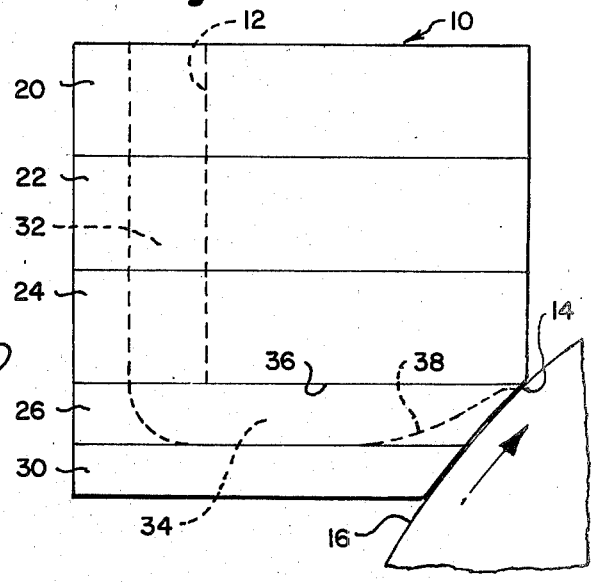
FIG. 4 is a side elevation view of an alternative apparatus of the present invention.

Referring particularly to the drawings, FIGS. 1–4 illustrate various preferred apparatus of the present invention. As shown in the drawing, the apparatus includes a tundish generally designated by reference numeral 10. The tundish 10 necessarily has an internal cavity 12 identified by hashed lines in FIGS. 1, 3 and 4. The internal cavity 12 is designed to receive and hold molten metal. The tundish 10 further includes an orifice passage 14, or nozzle, through which the molten metal in the cavity is delivered to a casting surface 16 such as illustrated in FIG. 4.

In a preferred embodiment, molten metal is delivered from the orifice passage 14 onto the outer peripheral surface 16 of a water cooled precipitation hardened copper alloy wheel containing about 99% copper. Copper and copper alloys are chosen for their high thermal conductivity and wear resistance although other materials may be utilized for the casting surface 16. In the operation of the apparatus of the present invention, the casting surface 16, whether round, flat or ovular, is movable past the orifice passage at a speed of from about 200 to about 10,000 linear surface feet per minute. It should be noted that such wheel could accomodate casting strip in either direction of rotation.

The molten metal is delivered from the cavity to the casting surface 16 located within about 0.120 inch of orifice passage 14. Preferably, the casting surface 16 is located within about 0.080 inch from the orifice passage. More preferably, surface 16 is located within about 0.020 inch, and may be within about 0.015 inch from the orifice passage 14. To achieve such locations, the tundish may be reciprocal toward and from casting surface 16.

As shown in the drawings, the tundish 10 has at least one upper block 20 and at least one lower block 30. As used in the present invention, the terms upper and lower, as well as the terms front and rear are used with general respect and reference to the casting surface 16 with the terms upper and rear referring to locations away from the casting surface 16.

Figure 17:
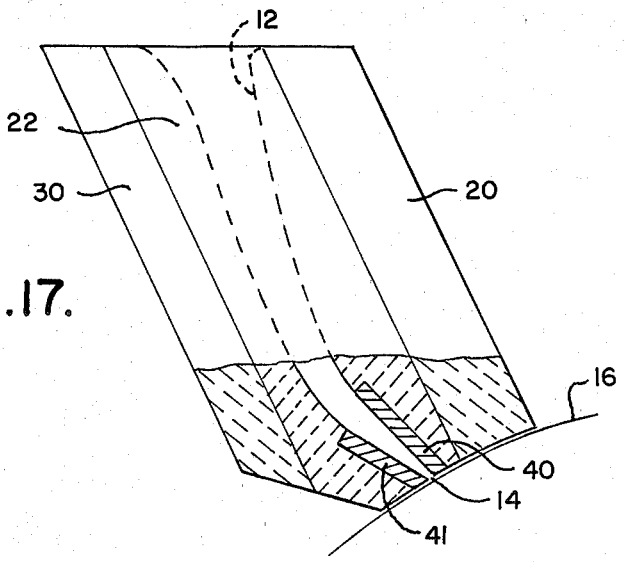

The upper and lower blocks 20 and 30 of the tundish 10 of the present invention are vertically aligned and secured together. In the interests of clarity, the term vertical alignment, as used throughout this application means that the sheet normal vector of all of the blocks forming a tundish is perpendicular to the axis of the casting wheel when casting is performed on a circular casting surface, or to the transverse direction of the casting surface when casting is performed on a linear casting surface, such as the flat section of a casting belt. When casting is performed on a curved section of a casting belt, such section should be equated with a circular casting surface. The sheet normal vector is that directed line segment which is perpendicular to the planar surface of a block or sheet. It will be appreciated that in most instances such defined relationship will result in vertical alignment of the tundish blocks with respect to the direction of the force of gravity. Also, such arrangement will typically result in having the sheet normal of all blocks disposed substantially perpendicular to the longitudinal axis of the orifice passage 14, and thus substantially perpendicular to the longitudinal axis of orifice plates 40, when such plates are utilized, and also substantially perpendicular to the transverse direction of the strip being cast. Such typical arrangements are fully illustrated in the drawings. However, it should be understood that the tundish may be disposed at any location about a moving casting surface, or at a variety of configurations such as shown in FIG. 17, which necessitates the broad definition of the term vertical alignment, as set forth above.

The vertically aligned blocks are secured such that molten metal in the cavity does not pass through the interface of the assembly. It should be understood that in instances where the nozzle is located at the interface, as best shown in FIG. 2, molten metal is intended to pass therethrough. Therefore, the interface, as defined above, is not intended to include that portion of the assembly which defines the orifice passage 14.

Figure 16:
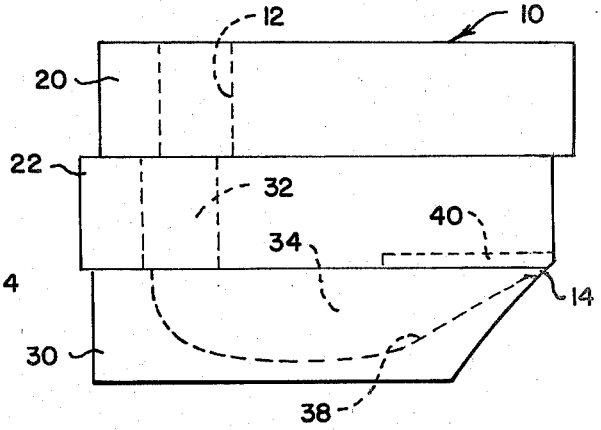

Any number of intermediate blocks 22, 24 and 26 may be disposed between the upper block 20 and the lower block 30. Vertical alignment of such blocks must be sufficient to insure that the cavity defined inside the tundish assembly provides an unrestricted path for molten metal to flow from the cavity opening through the cavity 12 to the orifice passage 14 and onto the casting surface 16. As shown in FIG. 16, the vertically stacked blocks do not have to be the same size, nor do the blocks have to be in perfect alignment, nor does the cavity 12 have to be in perfect alignment, although these conditions are preferred. It should also be noted that the tundish 10 need not have the rectangular configuration illustrated in the drawings. It should also be appreciated that additional blocks may be provided below the tundish assembly of the present invention for insulative stability or other reasons.

The blocks utilized in the apparatus of the present invention must be resistant to molten metal attack. In this regard, it has been found that refractory boards, such as insulating boards made from fiberized kaolin are suitable. Additional materials including graphite, alumina graphite, clay graphite, fire clay, quartz, boron nitride, silicon nitride, silicon carbide, boron carbide, silica, alumina, zirconia, stabilized zirconia silicate, magnesia, chrome magnesite, and combinations of such materials including impregnations of such materials, may also be used to construct such blocks.

In a preferred embodiment, the tundish is constructed of vertically stacked sections of 1.5 inch thick Kaolwool fiberboard. In a preferred embodiment, the surfaces of kaolin which are exposed to molten metal are impregnated with a silica gel. It should be noted that thicker or thinner blocks may be employed depending upon the desirable strip casting conditions. The 1.5 inch thick blocks are utilized in this preferred embodiment because of their commercial availability. As mentioned above, the commercial availability of such materials is a significant advantage of this invention. Furthermore, such fiberized kaolin blocks are preferred because of their relatively low cost and because of the relative ease with which they can be drilled and carved into the desired final configurations. However, it should be understood that other materials such as those enumerated above, may perform equally well and may be cast instead of carved into their desired configurations when desired.

Figure 1:
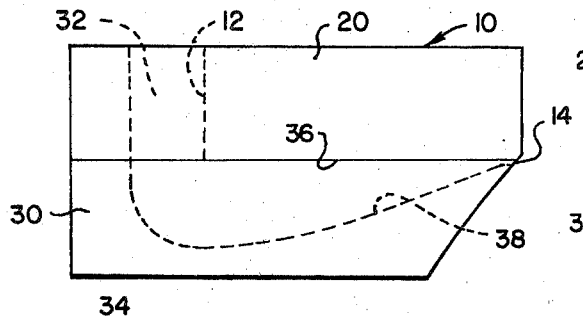
FIG. 1 is a side elevation view illustrating a tundish of the present invention.
Figure 5:
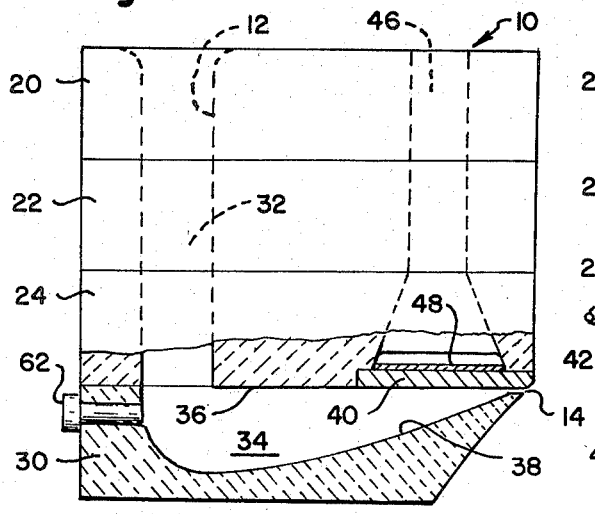
FIG. 5 is side elevation view, partly in section, of a tundish of the present invention illustrating means for heating a plate forming part of the orifice passage.
Figure 13:
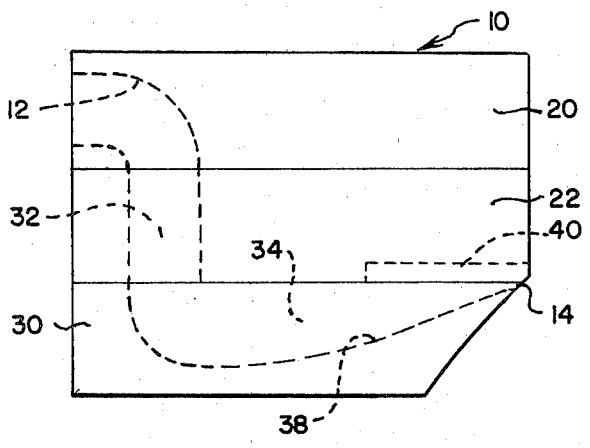
FIGS. 13–17 illustrate side elevation views of alternative tundishes of the present invention.

The tundish 10 of the present development includes a cavity 12 consisting of at least one introductory cavity portion 32. The introductory cavity portion 32 extends from the upper block 20 through any intermediate blocks and is in communication with a base cavity 34 formed in a hollow section at a lower portion of the tundish 10, typically formed in the bottom block 30. The opening for the introductory cavity portion 32 is preferrably located in the upper surface of the upper block 20 such as shown in FIGS. 1, 3 and 4, however, such opening may be disposed elsewhere such as that illustrated in FIG. 13. Also, as shown in FIG. 5 it is preferred that the opening be slightly radiused into a funnel shaped structure to facilitate metal transfer therethrough.

The formation of the base cavity portion 34 and the orifice passage 14 are critical in the apparatus of the present invention. The base cavity portion 34 is typically carved or cast in the bottom block 30 and is thereby formed between the bottom surface 36 of the block adjacent the bottom block and the carved surface 38. Alternatively, as shown in FIG. 4, the base cavity 34 may be formed in a carved intermediate block 26, with the bottom surface 38 of the base cavity 34 defined at least in part by the upper surface of a bottom block 30. Even in such latter embodiment, a portion of the upper surface of the bottom block may be removed for reasons described in detail below.

Figure 9:
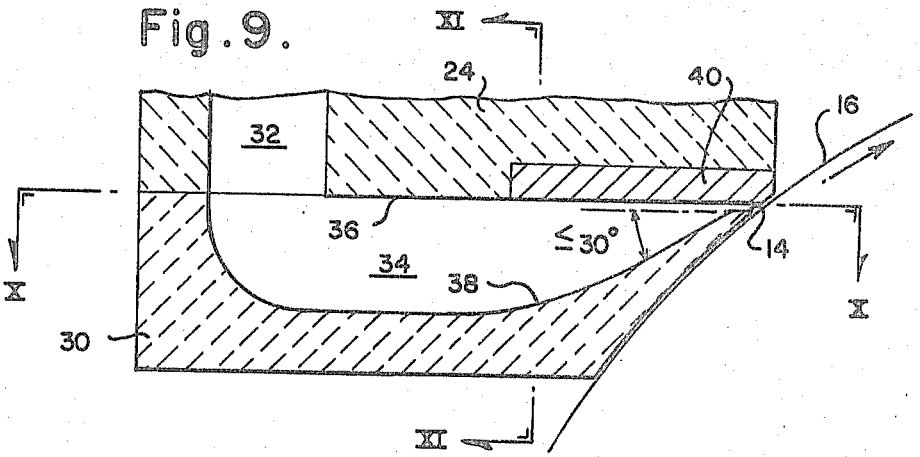
FIG. 9 is a cross sectional view of the base cavity and nozzle area of an apparatus of the present invention.
Figure 14:
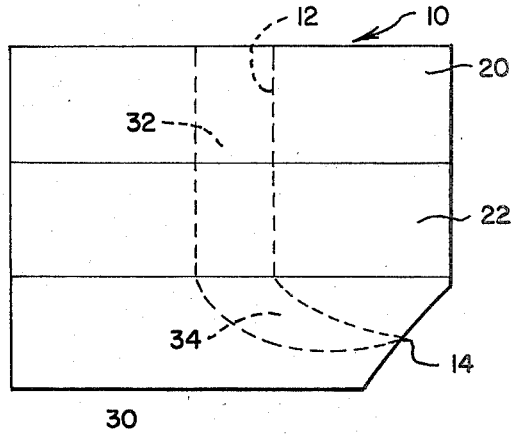

Though not required, the majority of the bottom surface 38 of the base cavity 34 is preferably disposed below the height of the orifice passage 14. FIG. 14 illustrates that such construction is not mandatory. In one embodiment, however, at least a portion of the bottom surface 38 of the base cavity 34 may be disposed at least about 0.125 inch below the orifice passage 14. Furthermore, it is desirable that the bottom surface 38 of the base cavity 34 extend toward or approach the nozzle at an angle of at least 20° and preferably at least 30° from horizontal as illustrated in FIG. 9. It should be understood that at less than 20° the molten metal approaching the orifice passage 14 may tend to freeze in the nozzle from lack of heat thus disrupting the casting operation.

The orifice passage 14 through which molten metal is fed into a casting surface 16 has a substantially uniform width dimension throughout the longitudinal extent thereof. Such width dimension is at least about 0.010 inch and preferably less than about 0.120 inch. More preferably, such substantially uniform width dimension W for the orifice passage 14 is less than 0.080 inch. In most preferred arrangements, the substantially uniform width dimension for the orifice passage 14 is within the range of from about 0.020 to 0.060 inch and ideally from about 0.030 to 0.050 inch.

The orifice passage 14 may be constructed in a number of ways in the apparatus of the present invention. In one embodiment, as illustrated in FIGS. 1 and 2, the orifice passage 14 is formed between the bottom surface 36 of the block 20 adjacent the bottom block 30, and an upper surface of the bottom block 30. The orifice passage 14 is formed by relieving a portion of at least one of these aligned blocks at such interface. It should be understood that the orifice passage could alternatively be formed by cutting a portion of the front wall of the block adjacent the bottom block alone or in combination with a cut-out portion of the bottom block 30. Regardless of which method is used to provide the orifice passage the strict dimensional tolerances mentioned above must be maintained.

Figure 6:
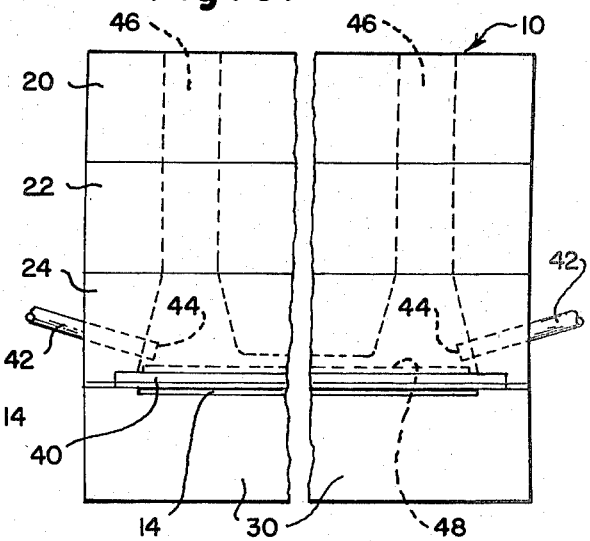
FIG. 6 is a front elevation view of the tundish illustrated in FIG. 5.
Figure 15:
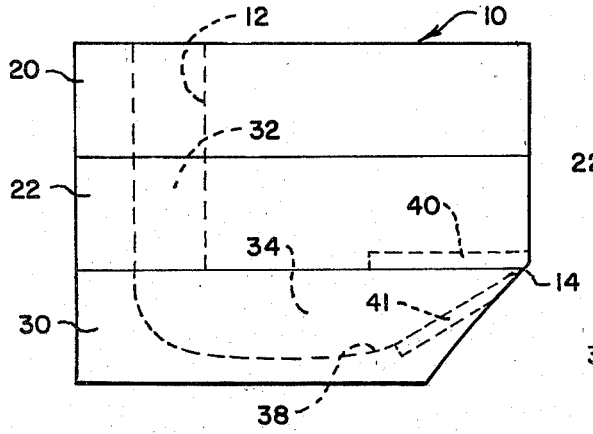

In a preferred embodiment such as is illustrated in FIGS. 5, 6 and 9 at least one surface forming the orifice passage comprises a plate 40 disposed in one of the blocks. As shown, it is preferable that the upper surface, i.e., the surface which is downstream with respect to the casting direction, of the orifice passage 14 comprise a surface of a plate 40 of molten metal resistant material. It should be understood that it is more critical to maintain the upper surface of the orifice passage during casting and, therefore, it is preferable to use a high strength plate at such location. However, the bottom surface could be defined by a plate 41 as shown in FIG. 15 or understandably both surfaces of the orifice passage, as shown in FIG. 15, may consist of a surface of a plate 40 and 41. Such plates 40 and 41, as well as the tundish assembly, should be resistant to the molten metal and preferably, the plate is significantly molten metal resistant, as well as dimensionally stable and errosion resistant as compared to the remainder of the tundish 10. Often, such plates are more resistant than the blocks forming the remainder of the tundish. As shown in FIG. 6 the plate 40 may be fit into an appropriate slot cut in the bottom surface of an intermediate block 24. Alternatively, the plate 40 can be set into the vertically stacked tundish blocks and the peripheral end portions of the plate 40 may be covered with appropriate insulation, such as Fiberfrax insulation to insulate and seal the edge portions of the plate 40. The plate 40 should have a length greater than the longitudinal extent of the orifice passage 14. By such arrangement, the peripheral end portions of the plate 40 are sandwiched between adjacent blocks 24 and 30 in the assembly of the present invention.

In a preferred embodiment the plate 40 is boron nitride, however other materials including fire clay, silicon nitride, silicon carbide, boron carbide, silica, alumina, zirconia, stabilized zirconium silicate, graphite, alumina graphite, clay graphite, quartz, magnesia, chrome magnesite, and combinations of such materials may be used for constructing the plate 40.

As discussed above, the introductory cavity portion 32 of the tundish 10 is in communication with the base cavity portion 34. In a preferred embodiment the introductory cavity portion 32 comprises a tubular passageway through a plurality of vertically stacked and secured blocks. The number of blocks employed or the total height of the tubular passageway should be that which is necessary to provide the cavity height required to control and contain the desired metallostatic head in the tundish. It should be appreciated that the casting pressure is directly related to the metallostatic head height. A wide range of head heights can be easily obtained by adding or subtracting intermediate blocks. It is also significant that these intermediate blocks and the upper block 20 are reusable through a plurality of casting operations.

As illustrated in FIGS. 5 and 6, means may be provided to heat the plate 40 forming the upper lip of the orifice passage. In a preferred embodiment, at least one lance 42 is disposed in the tundish with the tip 44 thereof directed toward an outside surface of the plate 40 with respect to the orifice passage 14. Also, as illustrated in FIGS. 5 and 6, a corresponding aperture or chimney 46 is provided in the tundish through which the combustion products which are delivered against the plate 40, may escape the tundish. It should be understood that any number of lances may be employed usually dependent upon the width of the strip to be cast from the tundish. By this embodiment the temperature of the plate 40 can be raised to the desired level prior to the initiation of a strip casting operation. It has been found that heating such plates near the melting temperature of the alloy to be cast prevents the metal from freezing in such cavity which may otherwise occur especially at the initiation of a casting operation. In a preferred embodiment high temperature acetylene flames are directed through the lance toward the plate. To reduce the possibility of undesired flame effects on such plate 40 a more flame resistant heat conductive layer 48 may be provided on at least a portion of the outside surface of the plate 40 at least at the location where such flames impinge against the plate 40. Such layer 48 serves to absorb the flame abuse and still effectively transfer the heat to the plate 40 therebelow. In a preferred embodiment, such layer 48 is graphite, although other materials may be employed.

Figure 7:
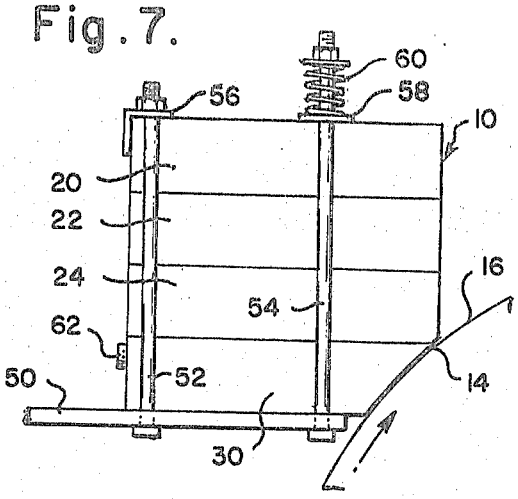
FIG. 7 is a side elevation view of a clamping mechanism for a tundish of the present invention.
Figure 8:
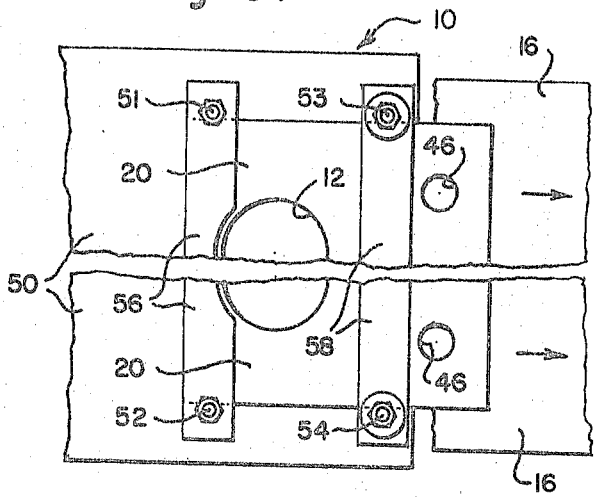
FIG. 8 is a top elevation view of the clamping mechanism and tundish illustrated in FIG. 7.

As mentioned above, it is required in the present invention that the vertically aligned blocks forming the tundish be secured. In a preferred embodiment the blocks forming the tundish are held in position on a support table 50 by way of four upright threaded rods 51, 52, 53 and 54 and two clamping bars 56 and 58, as shown in FIGS. 7 and 8. As shown in FIG. 7 the mid-section clamping bar 58 affects the major portion of the downward sealing and positioning force in this preferred clamping system. Such bar 58 is loaded in a preferred embodiment by springs 60 to insure continued downward force on the vertically aligned stack of tundish blocks following possible minor shrinkage in such blocks due to mechanical weakening which may be brought about, for example, by preheating and hot metal flow during strip casting. The rear clamp 56 which could also be spring biased further insures that the stack does not tilt forward towards the casting surface 16 because of such shrinkage and continued pressure, and also provides the pressure necessary to insure a leak-tight fit of the rear drain plug 62 which is discussed below. In addition to mechanical interlock of the tundish assembly, such assembly may also be secured with the use of screws, interlocking mechanisms, adhesives, cement such as alumina-silica cement, and other devices or combinations which prevent undesired metal flow through tundish block interfaces.

As shown in FIGS. 5 and 7 a drain plug 62 may be provided in a lower portion of the tundish. Such drain plug is preferably, though not necessarily, located vertically below the orifice passage 14. The purpose of the drain plug 62 is to quickly stop molten metal from being delivered from the orifice passage 14 when it is desired to stop a casting operation for any reason. It will be appreciated by those skilled in this art that when the decision has been made to discontinue casting, it is important to stop that casting operation as quickly as possible. Otherwise, uneven and often intermittent streams of molten metal may flow through the orifice passage 14 at the end of a casting operation and such intermittent streams may impinge onto the rapidly moving casting surface without the control necessary to produce commercially acceptable strip material. Thus, such uncontrolled drippings of molten metal through the nozzle at the end of a casting operation tend to splash onto the successfully cast product and could ruin the strip and perhaps damage some of the strip casting equipment. Also, in order to effect the reusability of the tundish it is important that the molten metal in the cavity 12 be drained from the tundish 10 at the end of a casting operation before solidification occurs. By removing such plug 62 substantially all of the molten metal in the tundish passes through the plug orifice and therefore the tundish is empty and the blocks are reusable in subsequent casting operations. It should be understood that proper recepticals should be provided to receive the molten metal which passes through the plug orifice from the tundish as the plug 62 is removed. Such plug 62 further may be pulled when problems are encountered during a casting operation in order to minimize the chances of causing damage to the strip or the casting equipment.

Figure 10:
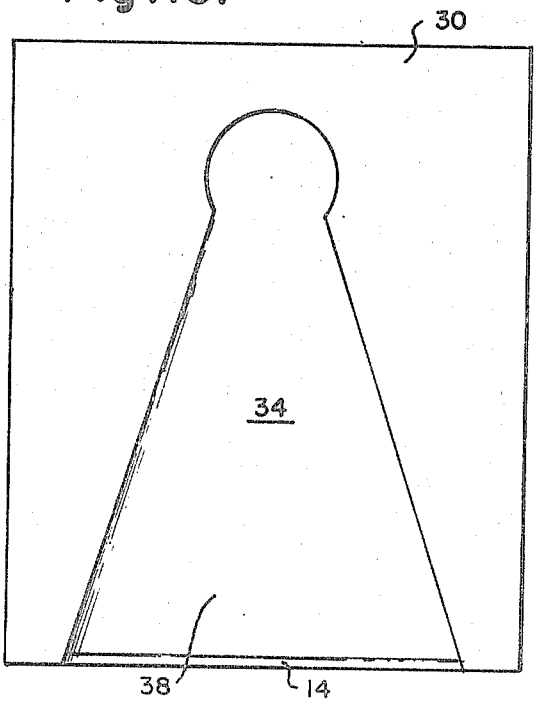
FIG. 10 is a plan view of the base cavity taken along line X—X of FIG. 9.
Figure 11:
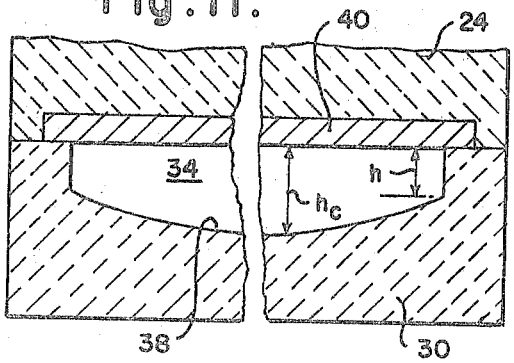
FIG. 11 is a transverse sectional view of the base cavity of the tundish of the present invention taken along lines XI—XI of FIG. 9.

FIGS. 9, 10 and 11 illustrate a preferred base cavity of the present invention. It has been found that the internal geometry of the casting cavity can be of major importance with respect to the final quality of the metallic strip material produced thereby. Such geometry factors seem to be significantly more important as the width of the cast strip material increases. It has been found that for a given set of conditions of melting temperature, metallostatic head height, orifice opening, plate 40 temperature, casting surface speed and orifice to casting surface distance, minor changes in the casting cavity design may produce significant variations in across width quality of wider metallic strip material if certain geometric preferred design features are not employed. These preferred features include two specific areas; cavity slope, and cross cavity profile. In the preferred embodiment as illustrated in FIG. 9 the bottom surface 38 of the base cavity 34 extends upwardly toward the orifice passage 14 at an angle of at least 20°, and preferably at least 30° from horizontal.

Also, in another preferred embodiment as illustrated in FIG. 11, at least a portion of the cross profile of the bottom surface 38 of the base cavity 34 has a dish type, or concave configuration. In particular, the height $h_c$ of the base cavity at a central portion, should be at least about 0.10 inch greater than the height h of base cavity 34 as measured at both lateral edges of the base cavity 34.

As indicated in the preferred embodiment shown in FIG. 10, the introductory cavity 32 may be provided by drilling an appropriately sized hole through vertically stacked blocks of molten metal resistant material. The bottom block 30 as shown in FIG. 10, may then be appropriately carved into an outwardly extending fan shaped structure. In particular, the base cavity 34 diverges outwardly from the bottom of the introductory cavity portion 32 in the direction of orifice passage 14, to a final orifice passage length which approximates the width of the strip to be cast. It should also be appreciated that a plurality of holes may be drilled into the vertically aligned blocks to provide the introductory cavity 32 often depending upon the width of the strip material to be cast.

Figure 12:
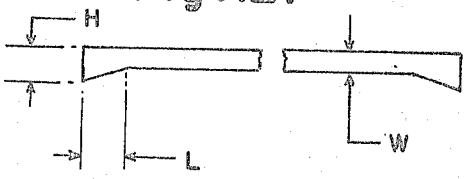
FIG. 12 is a front view of a preferred orifice passage of the present invention.

As mentioned above, the orifice passage 14 must have a substantially uniform width dimension, W, throughout the longitudinal extent thereof. Such width dimension, W, as shown in FIG. 12 may be slightly altered at the lateral edges of the orifice passage 14 without affecting the substantial uniformity. In particular, the edge equality of the metallic strip material produced by the apparatus of the present invention may be improved by fanning the lateral edge portions of the orifice passage 14. The height, H, to which such lateral edge portions may be fanned should not exceed 2.0 times, and preferably is less then 1.5 times the uniform width, W, of the orifice passage 14. Additionally, the length at the lateral end portions of the orifice passage 14 which can be fanned should not exceed three times and preferably is less than twice the uniform width of the orifice passage 14. As shown in FIG. 12 the preferred fanning arrangement is in the downward direction, however, it should be understood that such fanning may also be employed in the upward direction or in both directions. What is critical about such fanning structure is that more molten metal be made available at the lateral edge portions than is available along the internal portions of the orifice passage 14. Also, such fanning must continuously increase the height dimension, H, in the direction of the lateral edge of the orifice passage 14 and such height dimension, H, cannot be decreased in such lateral direction.

Whereas, the preferred embodiments of the present invention have been described above for purposes of illustration, it will be apparent to those skilled in the art that numerous variations of the details may be made without departing from the invention.

I claim:

1. An apparatus for continuously casting strip material comprising:

a tundish having an internal cavity for receiving and holding molten metal, and an orifice passage through which the molten metal is delivered from the cavity to a casting surface located within about 0.120 inch of the orifice passage and movable past the orifice passage at a speed of from 200 to 10,000 linear surface feet per minute, said tundish being constructed of a plurality of molten metal resistant blocks, and having at least one molten metal resistant upper block and at least one molten metal resistant lower block vertically aligned and secured, means for securing together the plurality of molten metal resistant blocks sufficiently to prevent molten metal in the cavity from passing through the interface of the secured blocks, and said orifice passage having a substantially uniform width dimension of at least about 0.010 inch, throughout the longitudinal extent thereof.

2. An apparatus as set forth in claim 1 wherein the orifice passage is formed by relieving a portion of at least one of the aligned blocks.

3. An apparatus as set forth in claim 1 wherein additional intermediate molten metal resistant blocks are vertically aligned and secured between the upper block and the lower block.

4. An apparatus as set forth in claim 1 or claim 3 wherein the blocks are molten metal resistant material selected from the group consisting of fiberized kaolin, graphite, alumina graphite, clay graphite, fire clay, quartz, boron nitride, silicon nitride, silicon carbide, boron carbide, silica, alumina, zirconia, stabilized zirconium silicate, magnesia, chrome magnesite and combinations thereof.

5. An apparatus as set forth in claim 1 wherein at least a portion of at least one surface forming the orifice passage comprises a plate disposed adjacent a block, which plate is at least as resistant to molten metal as the block.

6. An apparatus as set forth in claim 5 wherein at least a portion of at least one surface forming the orifice passage comprises a plate which is more resistant to molten metal than the blocks.

7. An apparatus as set forth in claim 5 or 6 wherein the plate is a molten metal resistant material selected from the group consisting of boron nitride, quartz, graphite, clay graphite, fire clay, silicon nitride, silicon carbide, boron carbide, silica, alumina, zirconia, stabilized zirconium silicate, magnesia, chrome magnesite and combinations thereof.

8. An apparatus as set forth in claim 6 wherein the apparatus further includes at least one heating lance directed through a portion of the tundish toward an outside surface of the plate with respect to the orifice passage, and an aperture through which combustion products from the lance may escape the tundish.

9. An apparatus as set forth in claim 8 wherein a heat conductive layer is provided on the outside surface of the plate at the location where the heating gases impinge thereon from the lance.

10. An apparatus as set forth in claim 9 wherein the heat conductive layer is graphite.

11. An apparatus as set forth in claim 1 wherein the blocks are secured by mechanical clamping devices.

12. An apparatus as set forth in claim 11 wherein the mechanical clamping device comprises a screw clamp disposed over a rear portion of the tundish and a spring loaded clamp disposed over a central portion of the tundish securing the tundish onto a support table disposed against a bottom surface of the tundish.

13. An apparatus as set forth in claim 1 wherein the blocks are secured by a refractory cement.

14. An apparatus as set forth in claim 13 wherein the refractory cement is an alumina silica cement.

15. An apparatus as set forth in claim 1 wherein the cavity consists of at least one introductory cavity portion and a base cavity portion in communication therewith.

16. An apparatus as set forth in claim 15 wherein the introductory cavity portion is generally tubular.

17. An apparatus as set forth in claim 16 wherein the introductory cavity is defined through a plurality of aligned blocks.

18. An apparatus as set forth in claim 15 wherein the base cavity is formed in a hollow section of the lower block.

19. An apparatus as set forth in claim 18 wherein the base cavity has a bottom surface the majority of which is disposed below the height of the orifice passage.

20. An apparatus as set forth in claim 19 wherein the bottom surface of the base cavity extends upwardly toward the orifice passage at an angle of at least about 20° from horizontal.

21. An apparatus as set forth in claim 19 wherein the bottom surface of the base cavity extends upwardly toward the orifice passage at an angle of at least about 30° from horizontal.

22. An apparatus as set forth in claim 19 wherein the base cavity has a height of at least 0.125 inch at least at a rearward location of the base cavity.

23. An apparatus as set forth in claim 22 wherein the central portion of the base cavity has a height of at least 0.10 inch greater than the height of the base cavity as measured at both lateral edges of the base cavity.

24. An apparatus as set forth in claim 1 wherein the tundish is reciprocal toward and from the casting surface.

25. An apparatus as set forth in claim 1 wherein the orifice passage has a width less than about 0.120 inch.

26. An apparatus as set forth in claim 1 wherein the orifice passage has a width less than about 0.080 inch.

27. An apparatus as set forth in claim 1 wherein the orifice passage has a width of about 0.020 to 0.060 inch.

28. An apparatus as set forth in claim 1 wherein the orifice passage has a width of about 0.030 to 0.050 inch.

29. An apparatus as set forth in claim 1 wherein the casting surface is located within about 0.080 inch from the orifice passage.

30. An apparatus as set forth in claim 1 wherein the casting surface is located within about 0.020 inch from the orifice passage.

31. An apparatus as set forth in claim 1 wherein the casting surface is located within about 0.015 inch from the orifice passage.

32. An apparatus as set forth in claim 1 wherein the orifice passage is defined between an upper lip and a lower lip, and both lateral end portions of the lower lip are spaced from the end portions of the upper lip to a width less than about 2.0 times the substantially uniform width dimension of the orifice passage for a length of less than about three times the substantially uniform width dimensions of the orifice passage.

33. An apparatus as set forth in claim 1 wherein the orifice passage is defined between an upper lip and a lower lip, and both lateral end portions of the lower lip are spaced from the end portion of the upper lip to a width less than about 1.5 times the substantially uniform width dimension of the orifice passage for a length of less than about twice the substantially uniform width dimension of the orifice passage.

34. An apparatus for continuously casting strip material comprising:

a tundish having an internal cavity for receiving and holding molten metal, and an orifice passage through which the molten metal is delivered from the cavity to a casting surface, located within about 0.020 inch from the orifice passage and movable past the orifice passage at a speed of from 200 to 10,000 linear surface feet per minute, said tundish having at least one molten metal resistant upper block, one molten metal resistant lower block and at least one molten metal resistant intermediate block vertically aligned and clamped sufficiently to prevent molten metal in the cavity from passing through the interface of the secured blocks, and said orifice passage formed between the lower block and an inside surface with respect to the orifice passage, of a boron nitride plate disposed within an intermediate block adjacent said lower block, said orifice passage having a substantially uniform width dimension of about 0.030 to 0.050 inch through the longitudinal extent thereof, said cavity consisting of at least one tubular introductory cavity extending from the upper block through the intermediate blocks in communication with the base cavity formed in a section of the lower block with the majority of a bottom surface of the base cavity disposed below the height of the orifice passage and extending upwardly toward the orifice passage at an angle of at least about 30° from horizontal, and at least one heating lance directed through a portion of the tundish for directing heating gases against a graphite coating on an outside surface, with respect to the orifice passage, of the boron nitride plate to heat said plate, and at least one aperture in the tundish through which combustion products from the lance may escape the tundish.

* * * * *